US005590952A

United States Patent [19]

Cheng et al.

[11] Patent Number: 5,590,952

[45] Date of Patent: Jan. 7, 1997

[54] LAMP ASSEMBLY FOR CHRISTMAS TREE LIGHT SETS

[76] Inventors: You-Jen Cheng; Tzu-Ling Cheng, both of P.O. Box 82-144, Taipei, Taiwan

[21] Appl. No.: 559,455

[22] Filed: Nov. 15, 1995

[51] Int. Cl.[6] ..... F21V 17/04

[52] U.S. Cl. ..... 362/255; 362/123; 362/293; 362/806; 362/226; 439/489

[58] Field of Search ..... 362/293, 123, 362/806, 255, 317, 351, 321, 257, 226; 439/488, 489, 255, 611; 313/112, 116

[56] References Cited

U.S. PATENT DOCUMENTS

| | | | |
|---|---|---|---|
| 1,625,591 | 4/1927 | Chase | 362/255 |
| 1,632,850 | 6/1927 | Raymond | 362/255 |
| 2,136,780 | 11/1938 | Berwick | 362/255 |
| 3,067,352 | 12/1962 | Vodicka et al. | 362/255 |

OTHER PUBLICATIONS

Panaro, Clicking Connector, IBM technical disclosure bulletin, whole disclosure Dec. 1958.

*Primary Examiner*—Ira S. Lazarus
*Assistant Examiner*—Thomas M. Sember
*Attorney, Agent, or Firm*—Alfred Lei

[57] ABSTRACT

A lamp assembly for Christmas tree light sets, including a lamp socket having a positive metal contact plate with raised portions and a negative metal contact plate on the inside, and a lamp bulb threaded into the lamp socket to force its ring contact and tip contact into contact with the negative metal contact plate and the positive metal contact plate, wherein the lamp bulb has a plurality of grooves spaced around the topmost edge of the ring contact, the grooves causing the negative metal contact plate to make sound when they are moved over the raised portions of the negative metal contact plate during the installation of the lamp bulb in the lamp socket, so that the operator can sense that the lamp bulb is threaded into position when no sound is produced. The lamp bulb has a patterned outside wall formed by: adhering patterned strips to the outside wall of the lamp bulb, then coating a color paint or the outside wall of the lamp bulb and the patterned strips, and then removing the patterned strips from the outside wall of the lamp bulb after the coating of the color paint is dried.

1 Claim, 3 Drawing Sheets

LAMP ASSEMBLY FOR CHRISTMAS TREE LIGHT SETS

BACKGROUND OF THE INVENTION

The present invention relates to lamps, and relates more particularly to a lamp assembly for Christmas tree light sets which gives an index when the lamp bulb is threaded into position, so as to prevent over pressure of the lamp bulb against the positive metal contact plate. The invention relates also to a method of make a lamp bulb having a patterned outside wall.

Various decorative strings and Christmas tree light sets are well-known and intensively used in western countries as well as most Asian countries during Christmas holidays. When installed, decorative strings and Christmas tree light sets are controlled to flash and to give different colors of light. A lamp assembly for decorative strings or Christmas tree light sets is generally comprised of a lamp socket and a lamp bulb threaded into the lamp socket. The lamp socket comprises a curved positive metal contact plate disposed at the bottom on the inside in a substantially horizontal position, and a straight negative metal contact plate disposed at one side in a substantially vertical position. The curved positive metal contact plate and the straight negative metal contact plate have a respective pointed tip, which pierces the insulator of the electric wire to make contact with a respective conductor in the electric wire. The straight negative metal contact plate further comprises a plurality of vertically spaced raised portions for engagement with the ring contact of the lamp bulb. When the lamp bulb is threaded into the lamp socket, the ring contact and tip contact of the lamp bulb are respectively disposed in contact with the straight negative metal contact plate and the curved positive metal contact plate, and therefore the lamp bulb is electrically connected to the electric wire. However, this structure of lamp assembly is still not satisfactory in function. Because the consumer tends to excessively thread the lamp bulb into the lamp socket, the curved positive metal contact plate will be forced to deform quickly, causing an elastic fatigue. If the springy power of the curved positive metal contact plate deteriorates, it cannot return to its former position after the removal of the lamp bulb, and an electric contact error will occur when a new lamp bulb is installed.

Furthermore, the lamp bulbs of conventional Christmas tree light sets may be differently colored. A colored lamp bulb for a Christmas tree light set made be directly molded from colored melting glass, or made by coating the outer surface of the bulb with a layer of colored paint. However, a colored lamp bulb made according to conventional methods presents only one color, which is monotonous, and cannot attract the consumers' attention.

SUMMARY OF THE INVENTION

The present invention has been accomplished under the circumstances in view. According to one aspect of the present invention, the lamp assembly comprises a lamp socket having a positive metal contact plate with raised portions and a negative metal contact plate on the inside, and a lamp bulb threaded into the lamp socket to force its ring contact and tip contact into contact with the negative metal contact plate and the positive metal contact plate, wherein the lamp bulb has a plurality of grooves spaced around the topmost edge of the ring contact, the grooves causing the negative metal contact plate to make sound when they are moved over the raised portions of the negative metal contact plate during the installation of the lamp bulb in the lamp socket, so that the operator can sense that the lamp bulb is threaded into position when no sound is produced.

According to another aspect of the present invention, the lamp bulb has a patterned outside wall, which is formed by: adhering patterned strips to the outside wall of the lamp bulb, then coating a color paint on the outside wall of the lamp bulb and the patterned strips, and then removing the patterned strips from the outside wall of the lamp bulb after the coating of the color paint is dried.

DETAILED DESCRIPTION OF THE PREFERRED EMBODIMENT

Figure 1:
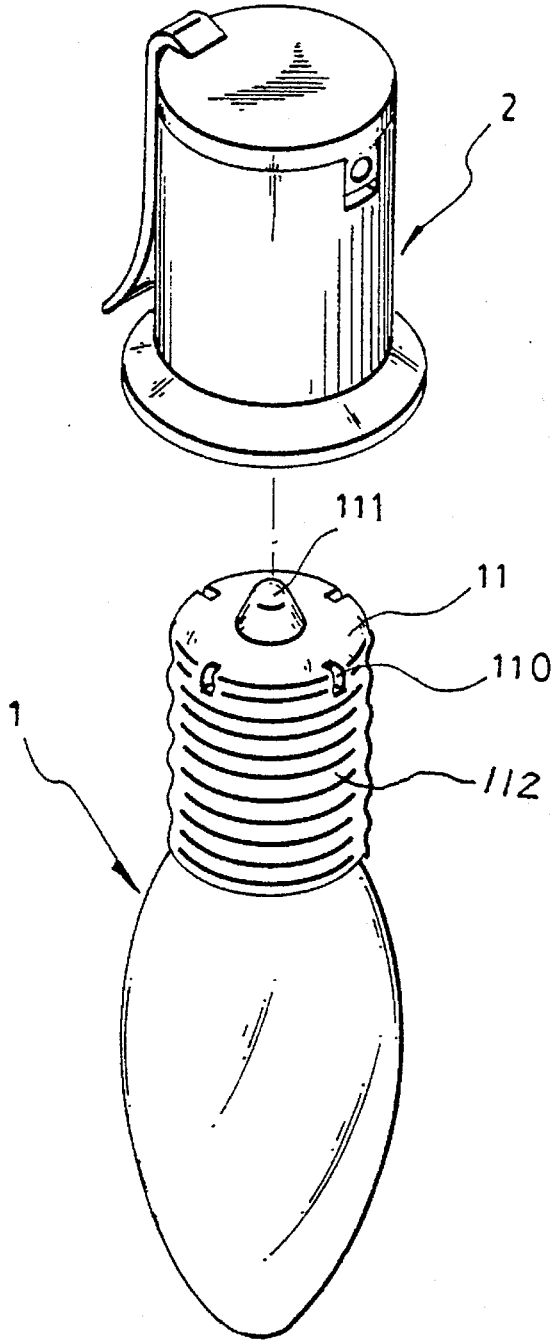
FIG. 1 is an exploded view of a lamp assembly according to the present invention.
Figure 2:
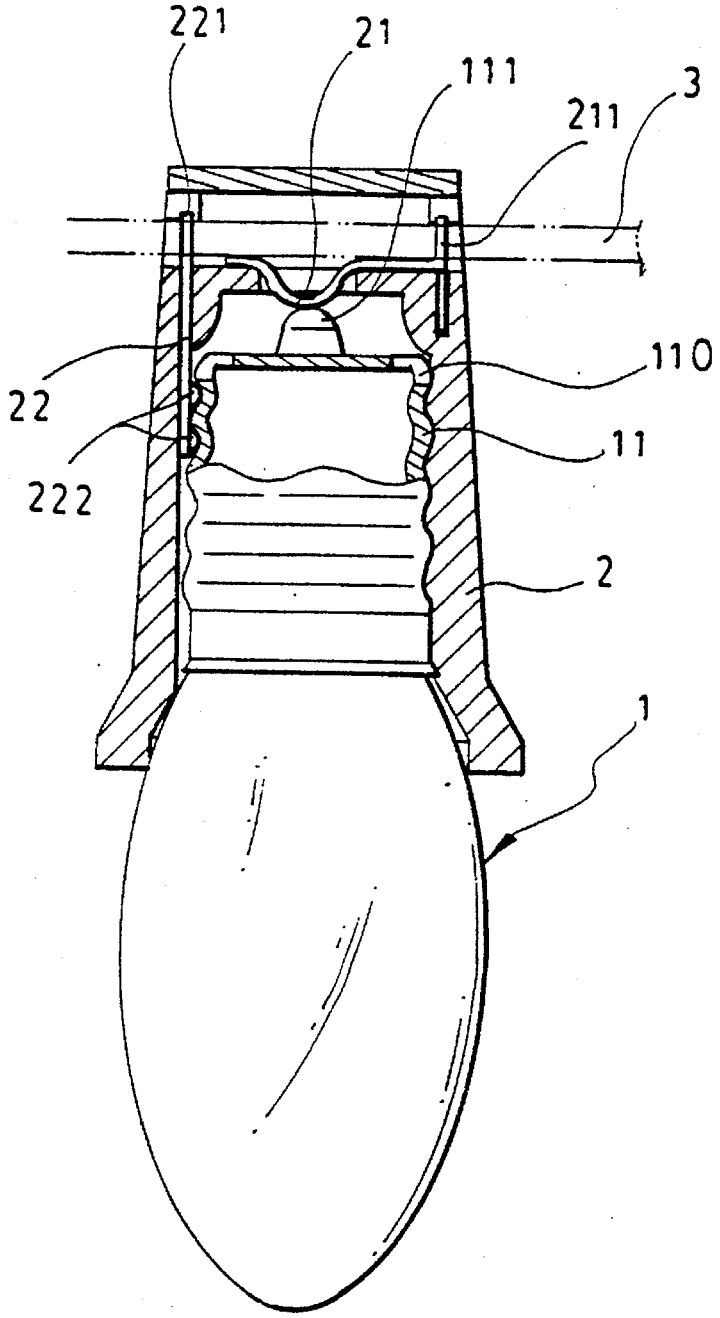
FIG. 2 is a sectional view of assembly view of the lamp assembly shown in FIG. 1.

Referring to FIGS. 1 and 2, a lamp assembly for a Christmas tree light is generally comprised of a colored lamp bulb 1, and a lamp socket 2. The colored lamp bulb 1 has a base 11 at one end, a tip contact 111 raised from the center of the top side of the base 11, and a plurality of grooves 110 spaced around the border of the top side and extending from a part of the top side to the ring contact 112 at a certain distance. The lamp socket 2 comprises a curved positive metal contact plate 21 disposed at the bottom on the inside in a substantially horizontal position, and a straight negative metal contact plate 22 disposed at one side in a substantially vertical position. The curved positive metal contact plate 21 has an upward pointed tip 211 at one side. The straight negative metal contact plate 22 has a top end terminating in a pointed tip 221, and a plurality of raised portions 222 disposed at an outer side at different elevations. When installed, the pointed tips 211 and 221 pierce the insulator of the electric wire 3 to make electric contact with a respective conductor. When the base 11 of the lamp bulb 1 is threaded into the lamp socket 2, the ring contact 112 is disposed in contact with the straight negative metal contact plate 22, and the tip contact 111 is disposed in contact with the curved positive metal contact plate 21.

Referring to FIG. 2 again, when the base 11 of the lamp bulb 1 is being threaded into the lamp socket 2 at the initial stage, the grooves 110 of the base 11 will be moved over the raised portions 222 of the straight negative metal contact plate 22. Each time one groove 110 passes over one raised portion 222, a click sound will be produced. When the grooves 110 pass over all raised portions 222, no sound will be produced further, and therefore the operator can sense that the lamp bulb has been threaded into position and shall not be continuously threaded inwards.

Figure 3:
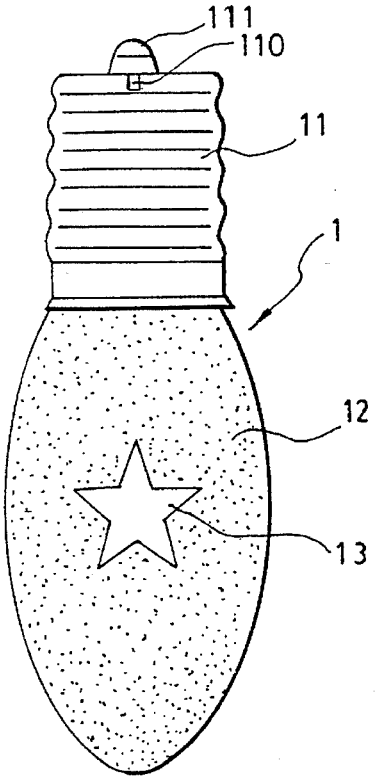
FIG. 3 shows a star pattern formed on the outside wall of the lamp bulb according to the present invention.
Figure 4:
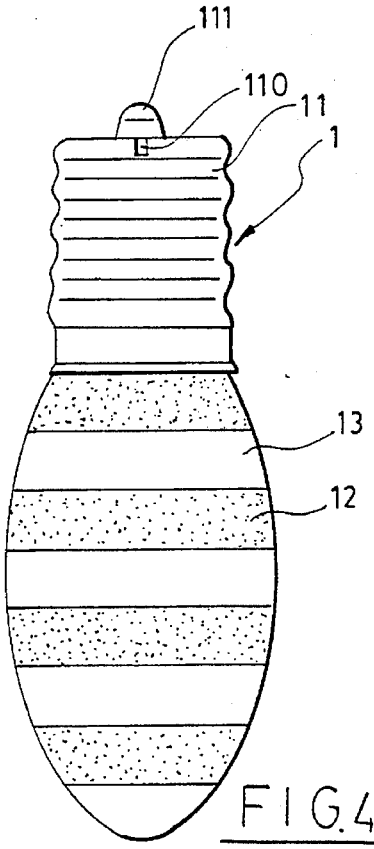
FIG. 4 shows transverse stripes formed around the outside wall of the lamp bulb according to the present invention.
Figure 5:
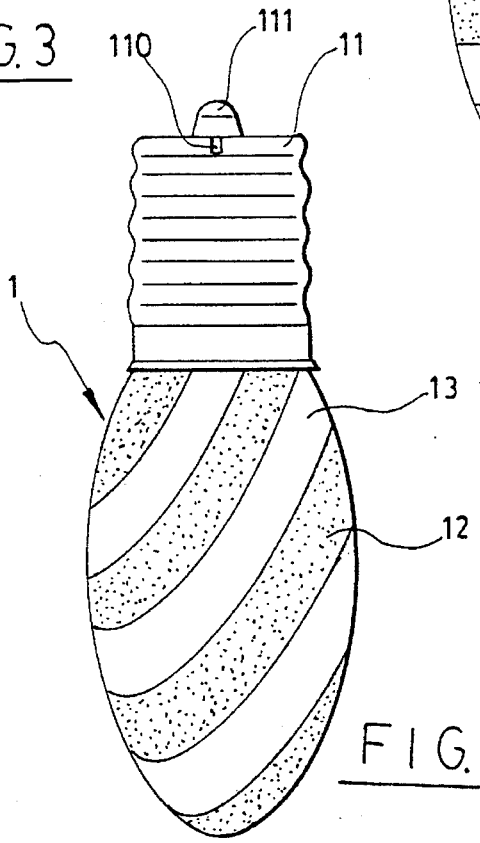
FIG. 5 shows oblique stripes formed around the outside wall of the lamp bulb according to the present invention.

Furthermore, the colored bulb 1 is molded from a prepared material which is obtained by adding a rare metal to the melting glass, then heating the molten mixture to a certain temperature, permitting the rare metal to be oxidized and then reduced. For example, when to produce a red color bulb, a certain amount of cobalt is added to the melting glass, then heating the molten mixture to 1000° C. minimum. After reduction, the molten mixture shows in red color. For making a patterned lamp bulb, patterned strips, for example, star-shaped strips, transverse strips, or oblique strips are adhered to the outside wall of the lamp bulb, and then a color paint is coated over the outside wall of the lamp bulb and the patterned strips. When the patterned strips are removed from the lamp bulb after the paint coating process, patterned portions 13 and paint coated portions 12 are formed over the outside wall of the lamp bulb 1 (see FIGS. 3, 4, and 5).

What is claimed is:

1. A lamp assembly for Christmas tree light sets, comprising a lamp socket having a positive metal contact plate and a negative metal contact plate, and a lamp bulb having a base threaded into said lamp socket, the base of said lamp bulb comprising a ring contact disposed in contact with said negative metal contact plate, and a tip contact disposed in contact with said positive metal contact plate, the negative metal contact plate having a plurality of vertically spaced raised portions for engagement with the ring contact of said lamp bulb, wherein said lamp bulb has a plurality of grooves spaced around a topmost edge of the ring contact, said grooves causing said negative metal contact plate to make sound when said grooves are moved over the raised portions of said negative metal contact plate during installation of said lamp bulb in said lamp socket, so that an operator can sense that the lamp bulb is threaded into position when no sound is produced; said lamp bulb has a patterned outside wall formed by: adhering patterned strips to the outside wall of said lamp bulb, then coating a color paint on the outside wall of said lamp bulb and said patterned strips, and then removing said patterned strips from said lamp bulb after the coating of said color paint is dried.

* * * * *